United States Patent [19]

Chang

[11] 4,329,618

[45] May 11, 1982

[54] HORIZONTAL DEFLECTION ENHANCEMENT FOR KINESCOPES

[75] Inventor: Kern K. N. Chang, Princeton, N.J.

[73] Assignee: RCA Corporation, New York, N.Y.

[21] Appl. No.: 154,602

[22] Filed: May 29, 1980

[51] Int. Cl.[3] ..... H01J 29/68; H01J 29/76

[52] U.S. Cl. ..... 313/431; 313/440; 313/443

[58] Field of Search ..... 313/443, 440, 431, 413, 313/442

[56] References Cited

U.S. PATENT DOCUMENTS

| | | | |
|---|---|---|---|
| 2,149,101 | 2/1939 | Ploke | 313/443 |
| 2,619,607 | 11/1952 | Steers | 313/443 |
| 2,785,330 | 3/1957 | Fogelberg et al. | 313/443 |
| 3,373,310 | 3/1968 | Worcester | 315/18 |
| 3,496,406 | 2/1970 | Deschamps | 315/17 |
| 3,860,850 | 1/1975 | Takenaka et al. | 313/431 |

*Primary Examiner*—Palmer C. Demeo

*Attorney, Agent, or Firm*—Eugene M. Whitacre; Glenn H. Bruestle; Lester L. Hallacher

[57] ABSTRACT

An enhancer for enhancing the horizontal deflection of an electron beam in a kinescope includes a quadrupole deflector. The quadrupole deflector is orientated so that the convergent action occurs in the same plane as the horizontal deflection. The divergent action is substantially decreased by utilizing additional members to shunt out the magnetic field which causes the divergent action.

7 Claims, 4 Drawing Figures

HORIZONTAL DEFLECTION ENHANCEMENT FOR KINESCOPES

BACKGROUND OF THE INVENTION

This invention relates generally to deflection systems for kinescopes and particularly to enhanced horizontal deflection for such devices.

Kinescopes typically include a funnel shaped evacuated envelope with the wide end closed by a light transparent faceplate. The inside of the faceplate is coated with one or more phosphor materials which luminesce when struck by electrons. A neck portion is attached to the narrow end of the funnel and houses an electron gun. The electron gun provides the electrons which travel as beams to the phosphor on the faceplate to produce a visual output which is either color or black and white depending upon the number of electron beams and phosphors on the faceplate. A deflection system is used to horizontally and vertically deflect the electron beams so that the entire faceplate is scanned by the electron beams. Typically, the deflection system includes a magnetic yoke positioned around the exterior of the tube neck.

The horizontal deflection angle of a kinescope is the total angular deflection of the electron beam away from both sides of the center line of the envelope. This angle varies in accordance with the strength of the magnetic field which causes the deflection and thus is a function of the voltage applied to the deflection coil. Therefore, the deflection angle can be increased by increasing the deflection voltage, this constitutes an increase in the power consumption and thus is inconsistent with efforts to increase the efficiency of kinescopes. Accordingly, in the absence of an increase in deflection voltage, an increase in the size of the faceplate requires an increase in the distance between the electron gun and the faceplate. This requires an increase in the overall length of the tube and thus is objectionable. Additionally, efforts today are directed toward decreasing both the power consumption and overall tube length. Efforts directed to both of these considerations have been unsuccessful because of the inability to increase the deflection angle without increasing one of the parameters which preferably should be decreased. These considerations have also caused the failure of efforts to construct a thin kinescope, that is a kinescope which is in the order of 6 inches (15.25 cm) in total length.

The instant invention is directed to a deflection enhancement device for enhancing the horizontal deflection of a kinescope without increasing the power requirements thereby permitting a substantial decrease in the overall length of the tube.

SUMMARY OF THE INVENTION

In a kinescope tube a quadrupole deflector is arranged between the electron gun and the display screen of the tube. The convergent action of the quadrupole acts in the same direction as the horizontal deflection. Enhancement of the horizontal deflection results from the use of the quadrupole. The divergent action of the quadrupole is substantially reduced by shunting out the magnetic field which acts in the vertical deflection direction. The vertical deflection of the kinescope, therefore, is uneffected by the quadrupole.

DETAILED DESCRIPTION OF THE PREFERRED EMBODIMENT

Figure 1:
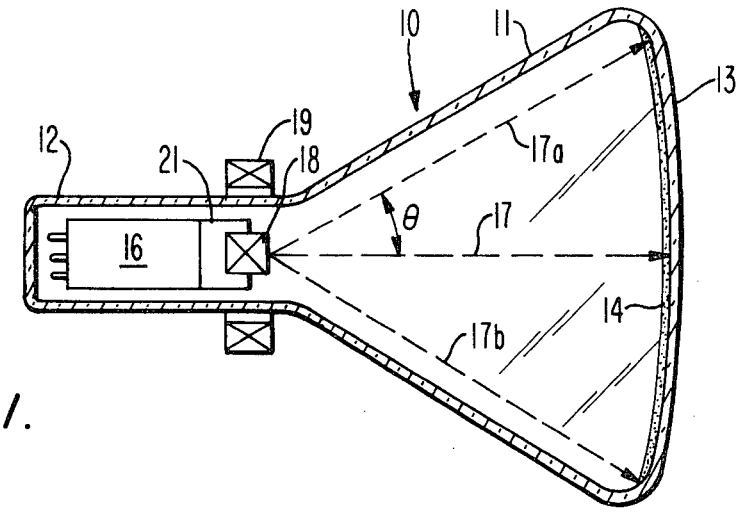
FIG. 1 is a schematic cross section of a kinescope showing the horizontal scan across the faceplate.
Figure 2A:
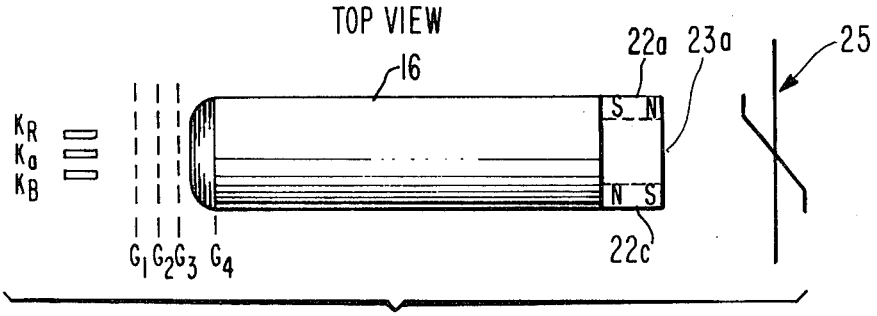
FIG. 2*a* is a top view of a preferred embodiment of the inventive deflection enhancement device coupled to the electron gun of the kinescope shown in FIG. 1.
Figure 2B:
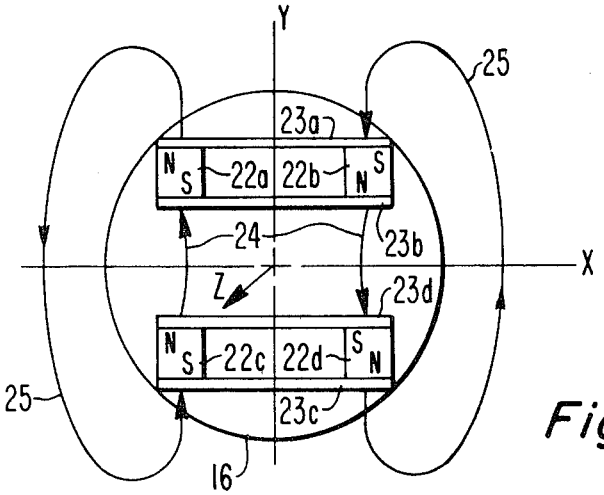
FIG. 2*b* is an end view of the preferred embodiment of FIG. 2*a*.

FIG. 1 shows a kinescope tube 10 having a funnel portion 11 and a neck portion 12. The funnel 11 is closed at the wide end by a transparent faceplate 13, the inside of which is coated with a phosphor material 14 which luminescenses when struck by electrons. Enclosed within the neck portion 12 is an electron gun 16 which provides a beam of electrons 17. The electron beam 17 is emitted from the electron gun 16 and travels to the phosphor coating 14 on the faceplate 13. A horizontal deflection coil 18 and a vertical deflection coil 19 are positioned around the outside of the neck portion 12. Typically, both the deflection coils 18 and 19 are separate windings on a single toroidal shaped yoke which is coaxially arranged about the outside of the neck 12. By applying a sawtooth shaped scanning voltage to the horizontal deflection coil 18, the electron beam 17 is scanned horizontally across the faceplate 13 between the two extreme positions 17*a* and 17*b*. Similarly, a vertical deflection voltage is applied to the vertical deflection coil 19 to cause the electron beam to vertically scan the faceplate 13. For the orientation illustrated in FIG. 1, the vertical scanning is perpendicular to both the plane of the paper and the horizontal scanning.

The total horizontal scan distance across the faceplate 13 can be increased by increasing either the scan angle $\theta$ or the distance between the gun 16 and the faceplate 13. The scan angle $\theta$ can be increased by increasing the deflection voltage applied to the horizontal deflection coil 18. However, this results in an increase in the power consumption of the system and accordingly is objectionable. Increasing the spacing between the gun 16 and the faceplate 13 is also objectionable because the resulting increase in size and weight is contrary to present efforts to decrease the length and weight of kinescopes. Efforts have been made to overcome these problems by use of quadrupole lenses. These lenses include two positive and two negative poles alternately spaced at 90° intervals which establish flux lines having internal portions inside the lens and external portions outside the lens. An electron beam, while passing through a quadrupole lens is influenced by the internal flux lines and experiences a convergent, or focusing, action in one plane and a divergent, or defocusing action in the other plane. After exiting from the quadrupole, the external portions of the flux lines, which cause the internal focusing action, tend to deflect the beam outwardly while the external portions of the flux lines, which cause the internal defocusing, tend to deflect the beam toward the axis of the tube. Quadrupole lenses, therfore, are not totally satisfactory because the defocusing action within the lens increases the diameter of the electron beam in one plane, resulting in an increase of the spot size, and the loss of resolution at the faceplate 13. Additionally, the focusing action outside the quadrupole decreases the deflection of the electron beam. The instant invention takes advantage of the internal focusing action and eliminates the disadvantages of the internal defocusing action.

FIG. 1 shows a quadrupole lens 21 coupled to the electron gun 16 and enclosed within the neck 12 of the kinescope envelope 10 in a position between the yoke 19 and screen 13. As shown in FIGS. *2a* and *2b*, the quadrupole lens 21 has been modified to eliminate the internal defocusing action and to enhance the horizontal deflection angle $\theta$ of the electron beam 17. In FIG. *2a* the quadrupole lens 21 is permanently attached to the electron gun 16 so that the electron beams pass through the lens. The electron gun 16 includes the three cathodes, KR, KG and KB, required to produce a color output on the faceplate 13. Also, shown schematically in FIG. *2a*, are the biasing grids, G1, G2, G3 and G4, which focus and control the electron beams in known manner.

As shown in FIG. *2b* the quadrupole 21 includes four permanent magnets, *22a*, *22b*, *22c* and *22d*, arranged at 90° intervals equidistant from the center of the gun 16 with alternating polarity. The x axis represents the horizontal scan direction and the y axis the vertical scan direction. For an electron beam traveling out of the plane of the paper, the focusing action within the quadrupole acts along the horizontal direction. Ferromagnetic members *23a* and *23b* extend between the oppositely poled magnets *22a* and *22b* on opposite sides of the magnets. Similarly the ferromagnetic members *23c* and *23d* extend between the oppositely poled magnets *22c* and *22d* on opposite sides of the magnets. The magnets are arranged with their poles parallel to the direction of vertical scanning with the two magnets on the same side of the vertical Y axis have the north pole facing in the same direction, but the magnets on opposite sides of the vertical axis have the north pole facing in the opposite direction. The two magnets, *22a* and *22b*, are positioned above the horizontal deflection axis so that the ferromagnetic members *23a* and *23b* are substantially parallel to such axis. Similarly, the magnets *22c* and *22d* are below the horizontal deflection axis with the members *23c* and *23d* substantially parallel to such axis. The pair of magnets, *22a* and *22b*, and the pair of magnets *22c* and *22d* are equally spaced on opposite sides of the horizontal scan axis. For an electron beam traveling out of the plane of the paper, represented by the vector Z in FIG. *2b*, the field lines 24 cause the horizontal focusing action while the electron beam is within the lens. The flux lines 24 are weakened by the presence of the shunts *23a*, *23b*, *23c* and *23d*, but are sufficiently strong to horizontally focus the electrons because of the orientation of the poles of the magnets *22a*, *22b*, *22c* and *22d*. However, the ferromagnetic members *23a*, *23b*, *23c* and *23d* shunt out the magnetic fields which ordinarily would cause in the internal vertical defocusing action. Accordingly, as the electron beams pass through the quadrupole the beams are converged, or focused, in the horizontal direction and are unaffected in the vertical direction. However, upon leaving the quadrupole the electron beams encounter the external magnetic fields 25, which in FIG. *2b* would extend out of the plane of the paper, and are deflected horizontally away from the center line of the tube. However, electrons leaving the quadrupole are unaffected vertically because of the elimination of the magnetic fields which would ordinarily cause the external vertical convergence. Accordingly, the horizontal deflection angle $\theta$ in FIG. 1 is substantially increased but the vertical electron beam deflection is unaffected because of the addition of the ferromagnetic members *23a*, *23b*, *23c* and *23d* to the quadrupole lens.

Figure 3:
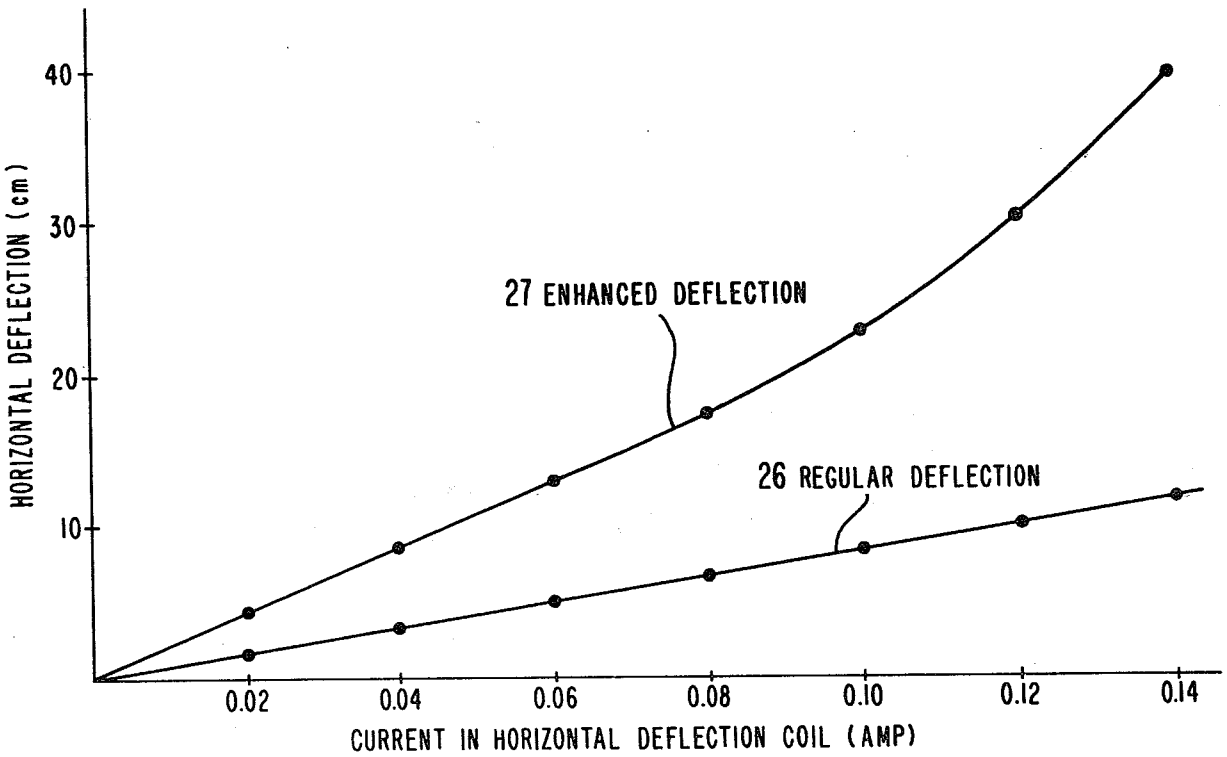
FIG. 3 is a graph showing the enhanced and regular horizontal deflection for various horizontal deflection currents.

FIG. 3 is a graph showing the marked increase in horizontal deflection obtained by utilizing the modified quadrupole 21 in conjunction with the normal horizontal deflection coil 18. In FIG. 3 the deflections are measured from the horizontal center of the faceplate 13. The deflections realized using only the deflection coil 18 are shown by curve 26 and the deflections realized using both the enhancement device and the yoke 18 are shown by curve 27. The deflection without the inventive enhancement device is approximately 10 centimeters for a horizontal deflection current is 0.14 amp. However, the horizontal deflection for 0.14 amp deflection current when the modified quadrupole 21 is used in conjunction with the deflection coil 18 is in excess of 40 centimeters. It will be noted in FIG. 3 that the enhanced deflection curve 27 is linear until a deflection current of approximately 0.08 amperes is used. The nonlinearity beyond this deflection current can be offset by circuitry, the design of which is within the preview of those skilled in the art and, therefore, the slight nonlinearity presents no problem in linearly scanning the faceplate.

Typically, kinescope tubes are identified by the total horizontal deflection angle. For example, 100° or 110° tubes indicate the total horizontal deflection with respect to the center line of the tubes. Thus as illustrated in FIG. 1, 100° and 110° tubes would respectively have values of 50° and 55° for the angle $\theta$. Utilizing the enhanced horizontal deflection device of the instant invention a horizontal deflection angle $\theta$ in excess of 80° can be obtained. Thus, tubes having a total deflection angle in the order of 160° to 170° can be obtained utilizing the instant invention. This permits a substantial reduction in the spacing between the electron gun and the faceplate permitting a substantial reduction in the overall length of the kinescope.

Another distinct advantage realized from the inventive enhancement device is the substantial reduction in power required for the horizontal deflection. FIG. 3 shows that the deflection current can be decreased by approximately 50% when the enhancement device is used along with the standard yoke.

What is claimed is:

1. In a kinescope having a screen, an electron gun for producing at least one electron beam and a deflection system for horizontally and vertically deflecting said electron beam to horizontally and vertically scan said screen, an improvement for enhancing the horizontal deflection comprising:

a quadrupole lens having internal and external fields, said internal fields producing a focusing action and a defocusing action orientated so that said focusing action converges said electron beam in the direction of said horizontal deflection and;

means for decreasing said internal defocusing action so that said electron beam is horizontally converged and vertically unaffected while passing through said internal fields of said quadrupole and horizontal deflection is increased and vertical deflection is unaffected when said beam encounters said external fields when exiting from said quadrupole.

2. The improvement of claim 1 wherein said quadrupole is composed of permanent magnets and wherein said means for decreasing includes ferromagnetic members for shunting the magnetic fields of said defocusing action.

3. The improvement of claim 1 wherein said quadrupole is composed of north and south poles alternately arranged at 90° intervals about the center of said gun and wherein said means for decreasing includes ferromagnetic members bridging the north and south pole pairs which produce said defocusing action so that the defocusing magnetic field of said quadrupole is substantially shunted out.

4. The improvement of claim 2 or 3 wherein said quadrupole is coupled to said electron gun and is arranged between said deflection system and said screen.

5. The improvement of claim 3 wherein said poles are permanent magnets and wherein one of said ferromagnetic members extends between two oppositely poled magnets above and substantially parallel to the horizontal center of said quadrupole and the other of said ferromagnetic members extends between another two oppositely poled magnets below and substantially parallel to the horizontal center of said quadrupole.

6. The improvement of claim 3 wherein said poles are permanent magnets and wherein there are four of said ferromagnetic members, two of said magnets having opposite polarity being positioned above and substantially parallel to the direction of said horizontal deflection and being arranged between two of said ferromagnetic members, and the other two of said magnets being positioned below and substantially parallel to said direction of horizontal deflection and being arranged between the other two of said ferromagnetic members.

7. The improvement of claim 3 or 6 wherein said permanent magnets are orientated with the north and south poles substantially parallel to the direction of vertical scanning and the magnets on one side of the vertical axis face in one direction and the magnets on the other side of the vertical axis face in the opposite direction.

* * * * *